US012624633B2

(12) United States Patent
Holmes et al.

(10) Patent No.: US 12,624,633 B2
(45) Date of Patent: May 12, 2026

(54) DETECTION OF ANOMALY IN A SUBSURFACE REGION

(71) Applicant: Chevron U.S.A. Inc., San Ramon, CA (US)

(72) Inventors: Robert Chadwick Holmes, Houston, TX (US); Frank Tamakloe, Houston, TX (US); Fabien J. Laugier, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 415 days.

(21) Appl. No.: 18/033,290

(22) PCT Filed: Nov. 10, 2021

(86) PCT No.: PCT/US2021/058835
§ 371 (c)(1),
(2) Date: Apr. 21, 2023

(87) PCT Pub. No.: WO2022/103875
PCT Pub. Date: May 19, 2022

(65) Prior Publication Data

US 2023/0399934 A1 Dec. 14, 2023

Related U.S. Application Data

(60) Provisional application No. 63/113,704, filed on Nov. 13, 2020.

(51) Int. Cl.
*E21B 47/09* (2012.01)
*E21B 44/00* (2006.01)
*G05B 19/042* (2006.01)

(52) U.S. Cl.
CPC ..... *E21B 47/09* (2013.01)

(58) Field of Classification Search
USPC ..... 382/204
See application file for complete search history.

(56) References Cited

U.S. PATENT DOCUMENTS 7,126,340 B1 10/2006 Ameen
9,279,323 B2 3/2016 Mullins
(Continued)

FOREIGN PATENT DOCUMENTS

CN 105389467 3/2016
CN 114880825 8/2022
(Continued)

OTHER PUBLICATIONS

Chaki, S., Routray, A., & Mohanty, W. K. (2018). Well-log and seismic data integration for reservoir characterization: A signal processing and machine-learning perspective. IEEE Signal Processing Magazine, 35(2), 72-81. (Year: 2018).*
(Continued)

*Primary Examiner* — Chineyere Wills-Burns
(74) *Attorney, Agent, or Firm* — Sheppard, Mullin, Richter & Hampton LLP

(57) ABSTRACT

A region of interest may include a group of wells. The group of wells may be connected to form a graph of wells, with nodes representing wells and edges representing connections between wells. Connection scores from dynamic time warping paths for individual pairs of connected wells may be used to detect anomalies in the region of interest. Number of boundaries within individual wells may be used to detect anomalies in the region of interest. Connection score and/or number of boundaries may be represented on a visual map of the region of interest.

20 Claims, 6 Drawing Sheets

(56) References Cited

U.S. PATENT DOCUMENTS

| | | | | |
|---|---|---|---|---|
| 10,459,098 | B2 | 10/2019 | Grant | |
| 11,131,184 | B1 * | 9/2021 | Alali | E21B 47/12 |
| 2007/0027666 | A1 | 2/2007 | Frankel | |
| 2007/0168133 | A1 | 7/2007 | Bennett | |
| 2012/0253770 | A1 | 10/2012 | Stern | |
| 2013/0261978 | A1 | 10/2013 | Xu | |
| 2014/0236549 | A1 | 8/2014 | Le Ravalec | |
| 2015/0035536 | A1 | 2/2015 | Tang | |
| 2018/0225778 | A1 | 8/2018 | Grant | |
| 2018/0240021 | A1 * | 8/2018 | Al-Harbi | E21B 43/00 |
| 2019/0383965 | A1 * | 12/2019 | Salman | G06N 3/0464 |
| 2020/0356856 | A1 * | 11/2020 | Moniruzzaman | G06N 3/09 |
| 2021/0048556 | A1 | 2/2021 | Sun | |
| 2021/0208302 | A1 | 7/2021 | Ma | |
| 2021/0301655 | A1 * | 9/2021 | Ranganathan | E21B 41/00 |
| 2021/0304060 | A1 * | 9/2021 | Al Madani | G01V 20/00 |
| 2022/0011457 | A1 * | 1/2022 | Al Ibrahim | G01V 20/00 |
| 2022/0120930 | A1 | 4/2022 | Kiselev | |
| 2023/0351079 | A1 | 11/2023 | Holmes | |
| 2023/0366309 | A1 | 11/2023 | Holmes | |
| 2024/0061146 | A1 | 2/2024 | Holmes | |

FOREIGN PATENT DOCUMENTS

| | | | | |
|---|---|---|---|---|
| WO | 2017135972 | | 8/2017 | |
| WO | WO-2017135972 | A1 * | 8/2017 | E21B 43/00 |
| WO | 2018164680 | | 9/2018 | |
| WO | 2020185918 | | 9/2020 | |

OTHER PUBLICATIONS

Florent Lallier et al: "Uncertainty assessment in the stratigraphic well correlation of a carbonate ramp: Method and application to the Beausset Basin, SE France", Comptes Rendus Geoscience, Elsevier, Paris, FR, vol. 348, No. 7, Jan. 25, 2016 (Jan. 25, 2016), pp. 499-509, XP029757193.

I. Le Nir et al: "Cross-Section Construction From Automated Well Log Correlation: A Dynamic Programming Approach Using Multiple Well Logs", SPWLA 39th Annual Logging Symposium, May 1, 1998 (May 1, 1998), XP055327733, Retrieved from the Internet: URL:https://www.onepetro.org/download/conference-paper/SPWLA-1998-DDDid=conferencepaper/SPWLA-1998-DDD[retrieved on Dec. 9, 2016].

Madof Andrew S. et al: "Stratigraphic aliasing and the transient nature of deep-water depositional sequences: Revisiting the Mississippi Fan", Geology, vol. 47, No. 6, Apr. 16, 2019 (Apr. 16, 2019) pp. 545-549, XP093179240.

Zhou et al. A Stratigraphic Prediction Method Based on Machine Learning. Applied Sciences [online], pp. 1-29, Aug. 29, 2019 [retrieved on Jan. 10, 2022]. Retrieved from the Internet: <URL:https://www.mdpi.com/2076-3417/9/17/3553/pdf>, especially pp. 1-29. entire document.

PCT International Search Report and Written Opinion for PCT Application No. PCT/US2021/058730, mailed Feb. 7, 2022 (8 pages).

PCT International Search Report and Written Opinion for PCT Application No. PCT/US2021/058819, mailed Feb. 7, 2022 (9 pages).

PCT International Search Report for Application No. PCT/US2021/058823, mailed Feb. 2, 2022 (8 pages).

PCT International Search Report and Written Opinion for PCT Application No. PCT/US2021/058835, mailed Feb. 4, 2022 (17 pages).

AU Examination Report from AU Application No. 2021377807 mailed Sep. 1, 2023 (3 pages).

AU Examination Report from AU Application No. 2021379607, mailed Aug. 31, 2023 (3 pages).

AU Examination Report from AU Application No. 2021380731 mailed Sep. 4, 2023 (4 pages).

* cited by examiner

300

DETECTION OF ANOMALY IN A SUBSURFACE REGION

CROSS-REFERENCE TO RELATED APPLICATION

The present application is a national stage application of International Application No. PCT/US21/58835, filed Nov. 10, 2021, which claims the benefit of U.S. Provisional Application No. 63/113,704, entitled "DETECTION OF ANOMALY IN A SUBSURFACE REGION," which was filed on Nov. 13, 2020, the entirety of which is hereby incorporated herein by reference.

FIELD

The present disclosure relates generally to the field of detecting subsurface anomalies.

BACKGROUND

Reservoir characterization from well data is a key challenge in subsurface analysis. Well data may include anomalies, such as problematic data, error in correlation interval, and/or localized data (e.g., local conditions impacts a well that adjacent wells do not intersect). Identifying such anomalies may be difficult, subjective, biased, and non-repeatable.

SUMMARY

This disclosure relates to detecting subsurface anomalies. Well information and/or other information may be obtained. The well information may define a group of wells within a region of interest. The group of wells may include multiple wells. Individual wells in the group of wells may be connected based on a distance threshold and/or other information to form a graph of wells. The graph of wells may include nodes representing the multiple wells and edges representing connections between pairs of the multiple wells. Dynamic time warping paths for individual pairs of the connected wells may be determined. The dynamic time warping paths may be characterized by connection scores for the individual pairs of the connected wells. One or more anomalies in the region of interest may be detected based on the connection scores for the individual pairs of the connected wells and/or other information.

A system that detects subsurface anomalies may include one or more electronic storage, one or more processors and/or other components. The electronic storage may store well information, information relating to wells, information relating to group of wells, information relating to region of interest, information relating to distance threshold, information relating to graph of wells, information relating to nodes, information relating to edges, information relating to dynamic time warping paths, information relating to connection scores, information relating to anomaly, and/or other information.

The processor(s) may be configured by machine-readable instructions. Executing the machine-readable instructions may cause the processor(s) to facilitate detecting subsurface anomalies. The machine-readable instructions may include one or more computer program components. The computer program components may include one or more of a well information component, a connection component, a path component, an anomaly component, and/or other computer program components.

The well information component may be configured to obtain well information and/or other information. The well information may define a group of wells within a region of interest. The group of wells may include multiple wells. In some implementations, the well information may include one or more well logs for the individual wells in the group of wells. The well log(s) for the individual wells may be normalized based on a log scaling and/or other information.

The connection component may be configured to connect individual wells in the group of wells. The individual wells in the group of wells may be connected based on a distance threshold and/or other information. The individual wells in the group of wells may be connected to form a graph of wells. The graph of wells may include nodes and edges. The nodes may represent the multiple wells and the edges may represent connections between pairs of the multiple wells.

In some implementations, the distance threshold may be adjusted such that none of the multiple wells are isolated.

The path component may be configured to determine dynamic time warping paths for individual pairs of the connected wells. The dynamic time warping paths may be characterized by connection scores for the individual pairs of the connected wells. In some implementations, the dynamic time warping paths for the individual pairs of the connected wells may be determined based on the normalized well log(s) for the individual wells and/or other information.

The anomaly component may be configured to detect one or more anomalies in the region of interest. The anomal(ies) may be detected based on the connection scores for the individual pairs of the connected wells and/or other information.

In some implementations, the anomal(ies) in the region of interest may include a transition and/or a partition between subgroups of wells within the region of interest. In some implementations, the anomal(ies) in the region of interest may include an unreliable well characterized by an unreliable well log.

In some implementations, the anomaly component may be configured to determine number of boundaries within the individual wells. The anomal(ies) in the region of interest may be detected further based on the number of boundaries within the individual wells.

In some implementations, the anomaly component may be configured to provide one or more visual representations of the graph of wells. In some implementations, a visual characteristic of the edges representing the connections between the pairs of the multiple wells may be determined based on the connection scores and/or other information. In some implementations, the connection scores may determine color of the edges representing the connections between the pairs of the multiple wells.

In some implementations, a visual characteristic of the nodes representing the multiple wells may be determined based on the number of boundaries within the individual wells and/or other information. In some implementations, the visual characteristic of the nodes representing the multiple wells may be gridded onto a surface representing the region of interest within the visual representation of the graph of wells.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

DETAILED DESCRIPTION

The present disclosure relates to detecting subsurface anomalies. A region of interest may include a group of wells. The group of wells may be connected to form a graph of wells, with nodes representing wells and edges representing connections between wells. Connection scores from dynamic time warping paths for individual pairs of connected wells may be used to detect anomalies in the region of interest. Number of boundaries within individual wells may be used to detect anomalies in the region of interest. Connection score and/or number of boundaries may be represented on a visual map of the region of interest.

Figure 1:
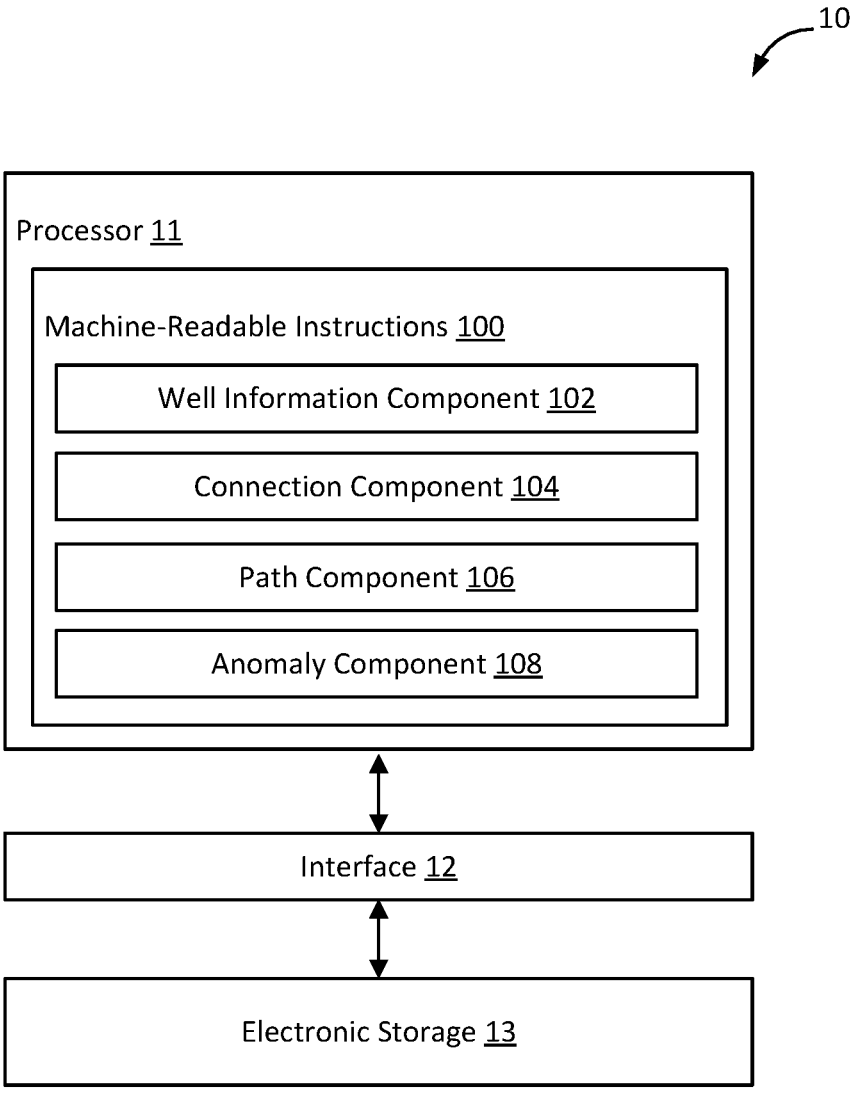
FIG. 1 illustrates an example system that detects subsurface anomalies.

The methods and systems of the present disclosure may be implemented by and/or in a computing system, such as a system 10 shown in FIG. 1. The system 10 may include one or more of a processor 11, an interface 12 (e.g., bus, wireless interface), an electronic storage 13, and/or other components. Well information and/or other information may be obtained by the processor 11. The well information may define a group of wells within a region of interest. The group of wells may include multiple wells. Individual wells in the group of wells may be connected by the processor 11 based on a distance threshold and/or other information to form a graph of wells. The graph of wells may include nodes representing the multiple wells and edges representing connections between pairs of the multiple wells. Dynamic time warping paths for individual pairs of the connected wells may be determined by the processor 11. The dynamic time warping paths may be characterized by connection scores for the individual pairs of the connected wells. One or more anomalies in the region of interest may be detected by the processor 11 based on the connection scores for the individual pairs of the connected wells and/or other information.

Reservoir characterization from well data (e.g., well log data, well core data) is a key challenge in subsurface analysis. One of the critical limiting factors of manual well log interpretation is the inability to fully assess the quantitative similarity or difference between two or more well logs due to the amount of information contained in the well logs.

Present disclosure addresses these limitations by providing techniques to detect anomalies in a subsurface region based on the well data. Anomalies between quantitatively correlated wells may be detected, assessed, and/or visualized. For example, anomalies may be interpreted as problematic data (well logs), error in correlation interval (input tops), local conditions impacting the well that adjacent wells do not intersect (geology), and/or other anomalies. Geological boundaries between wells may be interpreted as geologic in nature, representing faults or changes in stratigraphy.

Such detection of anomalies in a subsurface region enables identification of areas with consistent geologic properties (e.g., stratigraphic and/or structural properties) and areas with varying geologic properties. This allows for assessment of the variability in subsurface heterogeneity. This permits geoscientists to make more informed business decisions for the subsurface region, such as identifying optimal reservoir targets and resource density, identifying drilling locations, optimizing development strategies.

Referring back to FIG. 1, the electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store well information, information relating to wells, information relating to group of wells, information relating to region of interest, information relating to distance threshold, information relating to graph of wells, information relating to nodes, information relating to edges, information relating to dynamic time warping paths, information relating to connection scores, information relating to anomalies, and/or other information.

The processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate detecting subsurface anomalies. The machine-readable instructions 100 may include one or more computer program components. The machine-readable instructions 100 may include one or more of a well information component 102, a connection component 104, a path component 106, an anomaly component 108, and/or other computer program components.

The well information component 102 may be configured to obtain well information and/or other information. Obtaining well information may include one or more of accessing, acquiring, analyzing, creating, determining, examining, generating, identifying, loading, locating, opening, receiving, retrieving, reviewing, selecting, storing, utilizing, and/or otherwise obtaining the well information. The well information component 102 may obtain well information from one or more locations. For example, the well information component 102 may obtain well information from a storage location, such as the electronic storage 13, electronic storage of a device accessible via a network, and/or other locations. The well information component 102 may obtain well information from one or more hardware components (e.g., a computing device, a component of a computing device) and/or one or more software components (e.g., software running on a computing device). Well information may be stored within a single file or multiple files.

The well information may define a group of wells within a region of interest. The well information may define a group of wells by defining one or more characteristics of the group of wells. For example, the well information may define subsurface configuration of wells within a group of wells. A region of interest may refer to a region of earth that is of interest in correlating wells and/or detecting anomalies. For example, a region of interest may refer to a subsurface region (a part of earth located beneath the surface/located underground) for which well correlation and/or anomaly detection is desired to be performed. A group of wells may include multiple wells. A group of wells may refer to wells that are located within the region of interest. A group of wells may refer to some or all of the wells that are located within the region of interest. In some implementations, a group of wells may include wells that are representative of the region of interest.

Subsurface configuration of a well may refer to attribute, quality, and/or characteristics of the well. Subsurface configuration of a well may refer to type, property, and/or physical arrangement of materials (e.g., subsurface elements) within the well and/or surrounding the well. Examples of subsurface configuration may include types of subsurface materials, characteristics of subsurface materials, compositions of subsurface materials, arrangements/configurations of subsurface materials, physics of subsurface materials, and/or other subsurface configuration. For instance, subsurface configuration may include and/or define types, shapes, and/or properties of materials and/or layers that form subsurface (e.g., geological, petrophysical, geophysical, stratigraphic) structures. In some implementations, subsurface configuration of a well may be defined by values of one or more subsurface properties as a function of position within the well. A subsurface property may refer to a particular attribute, quality, and/or characteristics of the well.

The well information may define a group of wells by including information that describes, delineates, identifies, is associated with, quantifies, reflects, sets forth, and/or otherwise defines one or more of content, quality, attribute, feature, and/or other aspects of the group of wells. For example, the well information may define a well by including information that makes up the content of the well and/or information that is used to identify/determine the content of the wells.

In some implementations, the well information may include one or more well logs and/or associated information for the individual wells in the group of wells. The well information may include a single well log or a suite of well logs for individual wells in the group of wells. For instance, the well information may include one or more well logs (e.g., of natural well, of virtual well), information determined/extracted from one or more well logs (e.g., of natural well, or virtual well), information determined/extracted from one or more well cores (e.g., of natural well, or virtual well), and/or other information. For example, the well information may include one or more well logs relating to one or more properties of a well, such as rock types, layers, grain sizes, porosity, and/or permeability of the well at different positions within the well. Other types of well information are contemplated.

In some implementations, the well log(s) for the individual wells may be normalized based on a log scaling and/or other information. Individual well logs may be normalized to themselves. The type of normalization that is performed may depend on the scale of the well log. For example, linearly-scaled logs (e.g., gamma ray logs) may be normalized from value of zero to one based on threshold upper and lower quantiles. Non-linearly-scaled logs (e.g., deep resistivity logs) may be transformed/approximated to linear space, and then normalized from value of zero to one by the same/similar means. In some implementations, a Gaussian transformation may be applied to a well log to change the distribution of values within a target interval.

Normalization of the well logs may prepare the well logs for Continuous Wavelet Transform (CWT). The CWT may be performed on the normalized well logs based on an array of blocking windows (operator widths), and/or other information. The CWT may generate a multi-dimensional array of results.

The connection component 104 may be configured to connect individual wells in the group of wells. The individual wells in the group of wells may be connected based on a distance threshold and/or other information. Wells that are within the distance threshold (e.g., less than the distance threshold; equal or less than the distance threshold) may be connected. The value of the distance threshold (e.g., lateral/geographic distance threshold) may be selected to control the connectivity of wells in the group of wells. Wells that are not within the distance threshold may not be compared/correlated for detection of anomalies. The individual wells in the group of wells may be connected to form a graph of wells. The graph of wells may include nodes and edges. The nodes may represent the wells, and the edges may represent connections between pairs of wells.

In some implementations, the distance threshold may be manually set (e.g., user-defined value, default value). In some implementations, the distance threshold may be adjusted such that none of the multiple wells are isolated. The value of the distance threshold may be automatically adjusted to the value that results in all wells being connected to at least a desired/threshold number of wells. For example, the distance threshold may be adjusted to the smallest value to establish at least one connection for individual wells. Such connection of wells may reduce the amount of information available for anomaly detection. As another example, the distance threshold may be adjusted to the smallest value to establish at least a minimum (desired) number of connections for the individual wells in the group of wells. The value of the distance threshold may be automatically adjusted so that all wells are connected at least a minimum (desired) number of wells. As yet another example, the distance threshold may be adjusted to the value so that every well is connected to every other well. Increasing the number of connections between the wells may increase the amount of information available for anomaly detection. In some implementations, the distance threshold may be adjusted based on spatial distribution of wells. The distance threshold may be adjusted based on where a well is located within the region of interest and/or based on clustering of wells in the region of interest. Use of other criteria to adjust the value of the distance threshold are contemplated.

Figure 3:
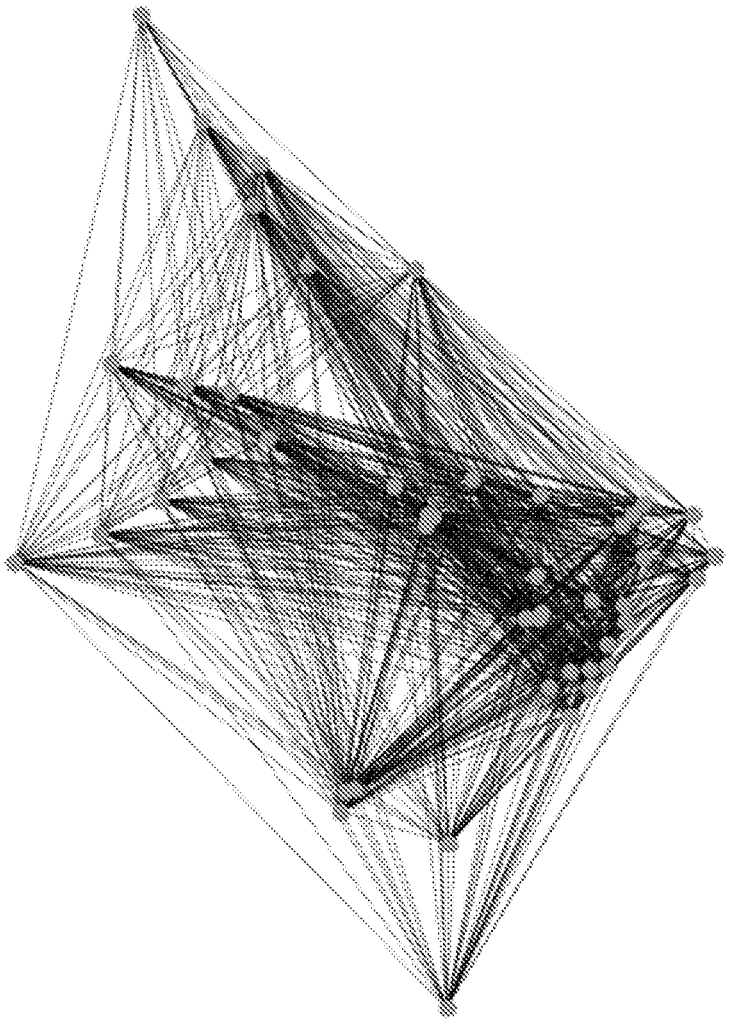
FIG. 3 illustrates example connections between wells.

FIG. 3 illustrates an example group of wells 300. Individual dots/circles in the group of wells 300 may represent a well in the region of interest. Lines between the dots/circles may represent connections between the wells. As shown in FIG. 3, individual wells in the group of wells 300 are connected to multitude of other wells in the group of wells 300.

The path component 106 may be configured to determine dynamic time warping paths for individual pairs of the connected wells. Dynamic time warping paths for individual pairs of the connected wells may be determined based on the well information for the individual wells and/or other information. For example, dynamic time warping paths for individual pairs of the connected wells may be determined based on the normalized well log(s) for the individual wells and/or other information. Dynamic time warping paths may be determined for those wells that have been connected together using the distance threshold. For example, a group of wells including three wells A, B, and C. Based on a distance threshold, wells A and B may be connected, wells B and C may be connected, and wells A and C may be connected. Dynamic time warping paths may be determined for well A-B pair, well B-C well, and well A-C well. Referring to FIG. 3, dynamic time warping paths may be determined for individual edges on the graph of wells.

In some implementations, the determination of a dynamic time warping path for a well-to-well connection may include calculation of an optimized dynamic time warping path for the well-to-well connection. The optimized dynamic time warp path may include indices that align the corresponding well logs at the least cost. The dynamic time warping path may be used to find the (best) correlation (e.g., best alignment of well logs) between individual pairs of connected wells.

The dynamic time warping paths may be characterized by connection scores for the individual pairs of the connected wells. A connection score for a pair of connected wells may refer to a value that characterizes and/or reflects the difficulty of aligning the corresponding well logs. A connection score for a pair of connection wells may indicate similarity and/or dissimilarity between the corresponding well logs. A connection score for a pair of connection wells may be provided by and/or obtained from the dynamic time warping paths.

The anomaly component 108 may be configured to detect one or more anomalies in the region of interest. An anomaly in the region of interest may refer to a portion/part of the region in which one or more deviations occur. An anomaly in the region of interest may refer to a portion/part of the region in which subsurface configuration/pattern changes beyond a threshold amount. An anomaly in the region of interest may refer to a portion/part of the region in which continuity of subsurface configuration/pattern is broken. For example, an anomaly in the region of interest may include a transition and/or a partition between subgroups of wells within the region of interest. For instance, an anomaly in the region of interest may include a geological boundary that separates different subgroups of wells within the region of interest. A geological boundary may be detected to be located between two subgroups of wells based on connection scores for connections between wells within a subgroup indicating low difficulty of aligning the wells within the subgroup while the connection across wells of different subgroups indicating high difficulty of aligning the wells of different subgroups.

An anomaly in the region of interest may refer to a portion/part of the region that may be misrepresented by the well information. For instance, an anomaly in the region of interest may include an unreliable well characterized by an unreliable well log. An unreliable well log may refer to a well log that does not accurately reflect the characteristics of the well at the corresponding location. That is, the well information may include a well log that poorly reflects the characteristics the well at the corresponding location. For example, a well may be identified as an unreliable well based on deviation of its connection scores from connection scores of nearby well. For instance, a well may be identified as an unreliable well based on its connection scores with nearby wells indicating high difficulty of aligning the well with nearby wells while the connection scores of the nearby wells indicate low difficulty of aligning with each other. Detection of other types of anomalies is contemplated.

The anomal(ies) in the region of interest may be detected based on the connection scores for the individual pairs of the connected wells and/or other information. For example, the anomal(ies) in the region of interest may be detected based on the difficulty of aligning pairs of connected wells within the region of interest. The anomal(ies) in the region of interest may be detected based on the similarity and/or dissimilarity between the well logs of the connected wells within the region of interest.

In some implementations, the anomaly component 108 may be configured to provide one or more visual representations of the graph of wells. A visual representation of the graph of wells may include visual representation of the wells, visual representation of the connections between the wells, visual representation of the connection scores for the connections between the wells, and/or other visual representations. For example, a visual representation of the graph of wells may include nodes representing the wells and edges representing connections between the wells.

In some implementations, one or more visual characteristics of the edges representing the connections between pairs of wells may be determined based on the connection scores and/or other information. The visual characteristic(s) of the edges between the nodes may be selected to reflect/indicate the connection scores for the connection between the wells. That is, the connection scores of the connections between the wells may control how the edges are presented within the visual representation(s) of the graph of wells. For example, the connection scores may determine color, brightness, and/or width of the edges representing the connections between the pairs of wells. Different colors, brightness, and/or widths of the edges between the nodes may represent different values of connection scores for the corresponding connection between the wells. As another example, the edges may be presented using different types of lines (e.g., solid line, dashed line, dotted line) to represent different values of connection scores for the corresponding connection between the wells. Other visual characteristics of edges are contemplated.

Figure 4A:
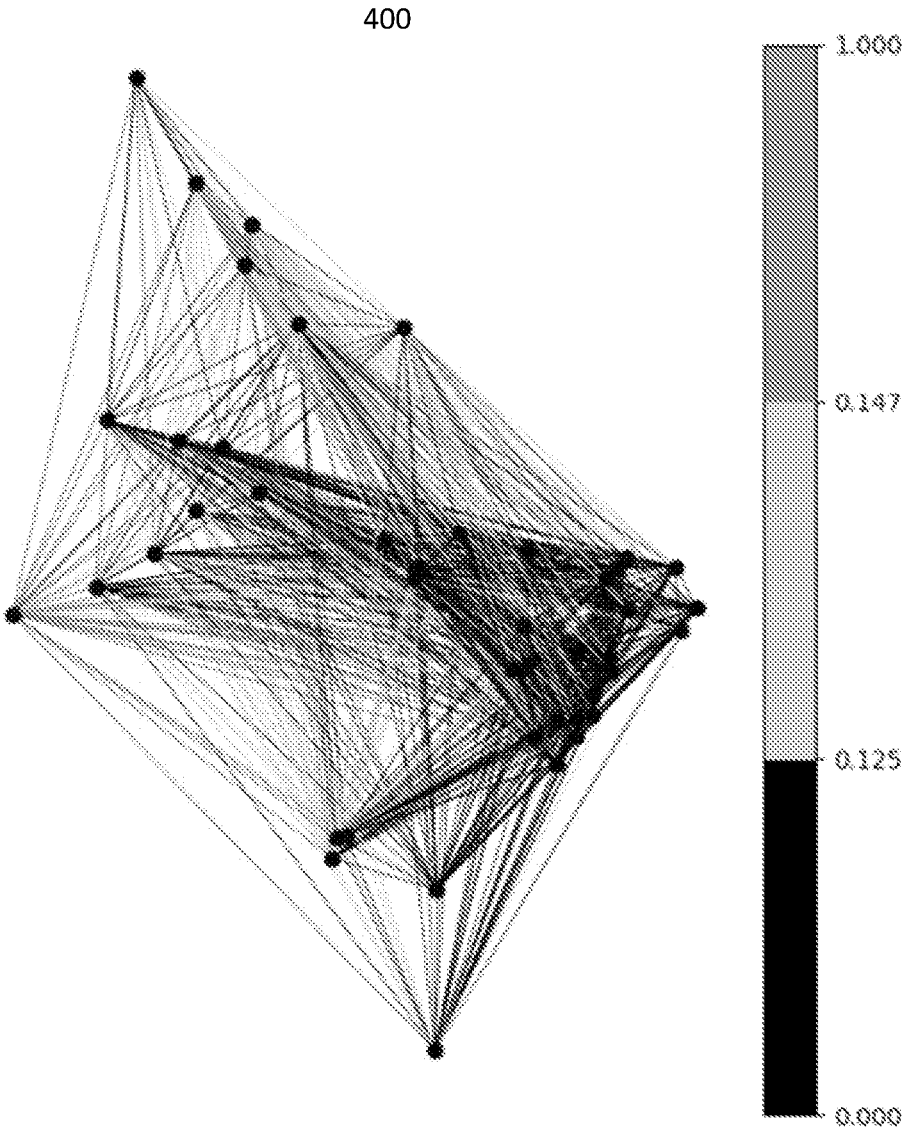
FIG. 4A illustrates example visualization of connection scores for connections between wells.

FIG. 4A illustrates example visualization of connection scores for connections between wells. FIG. 4A may include visualization of a graph of wells 400. Individual dots/circles in the graph of wells 400 may represent a well in the region of interest. Edges between the nodes may represent connections between the wells. The connection scores for the connections between the wells may range between value of zero and one. The visual characteristic(s) (e.g., color, brightness) of the edges may reflect the corresponding connection scores.

The visual characteristic(s) of the edges may highlight potential parts/portions of the region of interest in which an anomaly exists. For example, characteristic(s) of the edges may highlight potential parts/portions of the region of interest that have changed well similarity. For instance, characteristic(s) of the edges may highlight potential parts/portions of the region of interest in which there is a discontinuity in the subsurface configuration, such as changes in structure (e.g., faults) and/or stratigraphy (e.g., system termination).

Figure 4B:
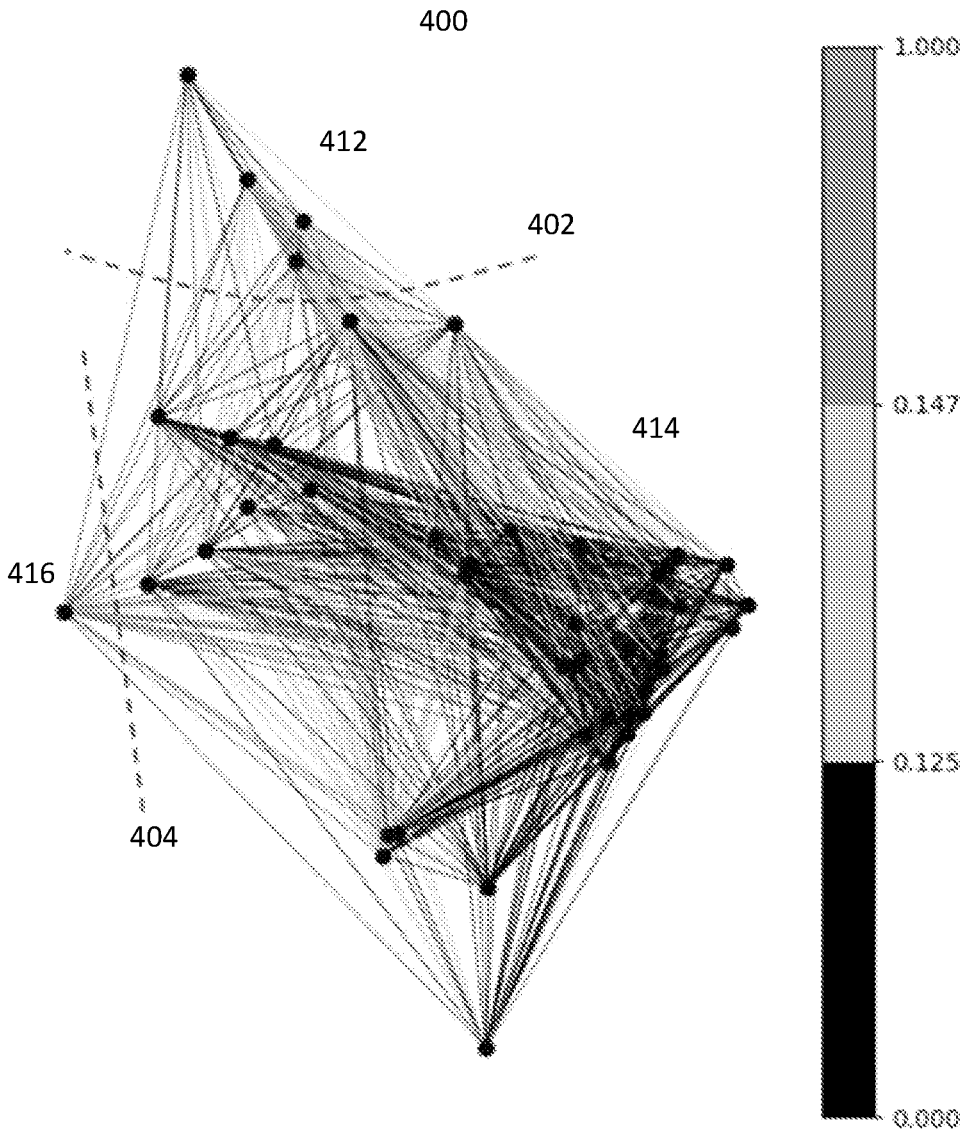
FIG. 4B illustrates example subgroups of wells.

FIG. 4B illustrates example subgroups of wells 412, 414, 416. The group of wells (represented by the nodes of the graph) may be divided into the subgroups of wells 412, 413, 416 based on identification of anomalies in the region of interest. For example, geological boundaries 402, 404 may be detected based on the connection scores for individual pairs of connected wells. The geological boundaries 402, 404 may indicate changes in structure and/or stratigraphy between the subgroups of wells 412, 414, 416.

The geological boundaries 402, 404 may be detected manually (e.g., a person identifying location of a geological boundary based on the visual characteristics of the edges) and/or automatically (e.g., a computer identifying location of a geological boundary based on the visual characteristics of the edges/corresponding connection scores). In some implementations, the geological boundaries 402, 404 may be detected based on multiple well pair connections showing high connection scores over a geographical swath, with the geological boundaries 402, 404 oriented such that the geological boundaries 402, 404 maintains maximum margin from wells in the associated well pairs. In some implementations, the geological boundaries 402, 404 may be detected based on boundary identification techniques, such as support vector machines (SVM) or other machine learning techniques.

While the geological boundaries 402, 404 are shown as lines in FIG. 4B, this is merely as an example and is not meant to be limiting. In some implementations, boundaries may be detected to cover areas within the region of interest. In some implementations, the geological boundaries may highlight areas within the region of interest that require further study.

In some implementations, the anomaly component 108 may be configured to determine number of boundaries within the individual wells. A boundary within a well may refer to a location (e.g., in time, space) within the well that separates two distinct segments/packages of the well. In some implementations, the number of boundaries within a well may be determined based on the CWT and/or other information. The CWT may be performed on a single log for a single well and/or on a suite of logs (multiple logs) for a single well. The same value of blocking windows for the CWT may be used to determine the number of boundaries within different wells. In some implementations, other/additional analysis of the well log(s) may be used to determine number of boundaries in the wells. For example, boundaries within a well may be identified based on changes in the well log(s) of the well that exceed one or more threshold values. Boundaries within a well may be identified based on a blocking analysis of one or more properties of the well log(s) (e.g., frequency changes in a spectrogram, running average). Boundaries within a well may be identified based on a seasonal decomposition of the well log(s). Use of other boundary identification techniques are contemplated.

The anomalies in the region of interest may be detected further based on the number of boundaries within the individual wells. That is, the number of boundaries within wells may be used to identify anomalies in the region of interest. The number of boundaries within wells may indicate heterogeneity/noisiness of the corresponding well logs. Patterns of heterogeneity/noisiness of the well logs may be used to detect anomalies in the region of interest. Changes in heterogeneity/noisiness of the well logs may indicate presence of one or more anomalies. For example, a single/few wells with high deviation in the number of boundaries from nearby wells may indicate presence of anomal(ies) between the single/few wells and nearby wells. Other use of the number of boundaries within wells to detect anomalies in the region are contemplated.

In some implementations, one or more visual characteristics of the nodes representing the wells may be determined based on the number of boundaries within the individual wells and/or other information. The visual characteristic(s) of the nodes may be selected to reflect/indicate the number of boundaries within the individual wells. That is, the number of boundaries within the wells may control how the nodes are presented within the visual representation(s) of the graph of wells. For example, the number of boundaries within the wells may determine color, brightness, patterns, shapes, and/or size of the nodes representing the wells. Different colors, brightness, patterns, shapes and/or sizes of the nodes may represent the different number of boundaries within the wells. Other visual characteristics of nodes are contemplated.

In some implementations, the visual characteristic of the nodes representing the multiple wells may be gridded onto a surface representing the region of interest within the visual representation of the graph of wells. The region of interest within which the wells are located may be presented as a surface. One or more visual characteristics of the surface may be determined based on the number of boundaries within the individual wells and/or other information. The number of boundaries within the wells may control how the surface representing the region of interest is visualized. For example, the color, brightness, and patterns of the surface may indicate the number of boundaries within different areas within the region of interest, as indicated by the number of boundaries within different wells. The number of boundaries within the well may be extrapolated to the region of interest to provide visualization of how the number of boundaries changes throughout the region of interest.

Figure 5:
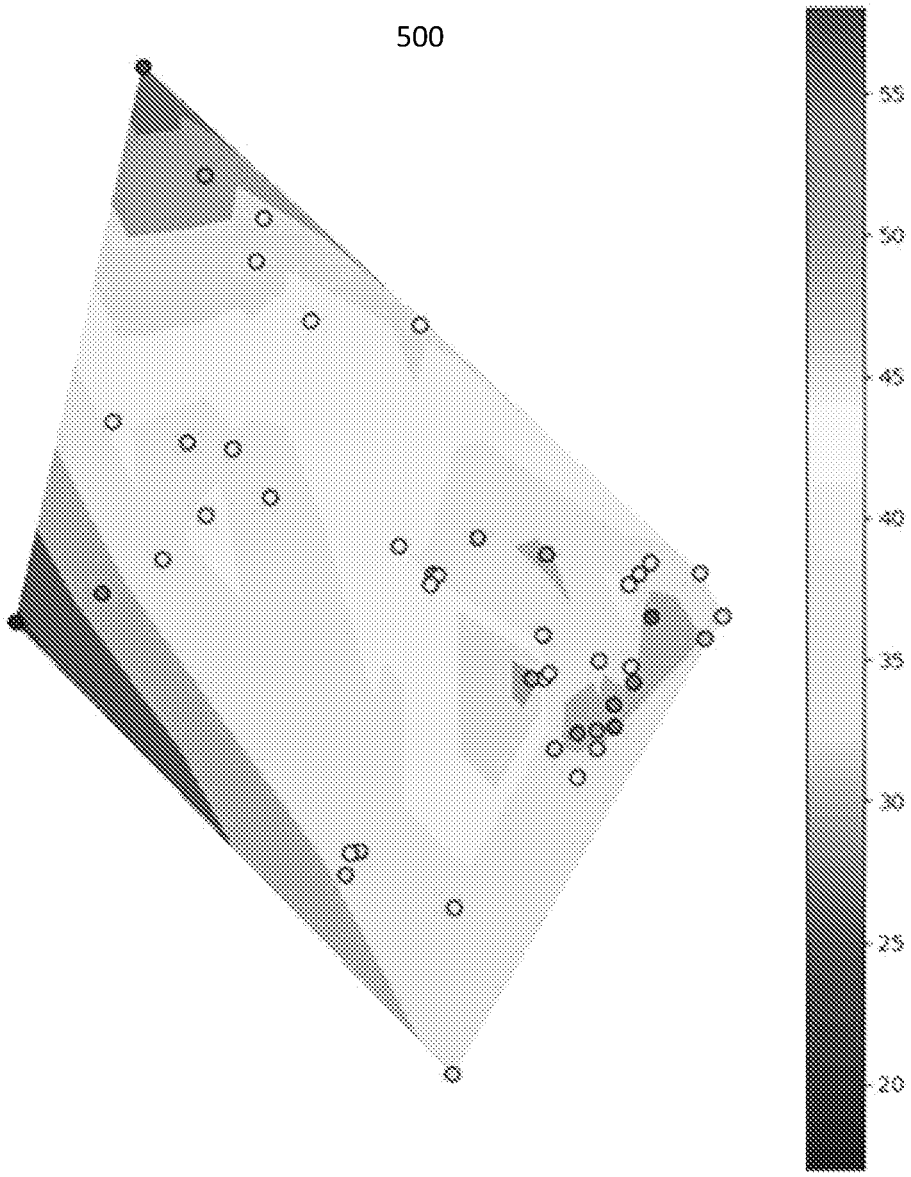
FIG. 5 illustrates example visualization of boundary numbers within a region of interest.

FIG. 5 illustrates example visualization 500 of boundary numbers within a region of interest. The visualization may include a surface to represent the region of interest. The visualization 500 may include circles to indicate location of wells within the region of interest. The visual characteristic(s) (e.g., color, brightness) of the surface/circles may reflect the number of boundaries within the corresponding location. The number of boundaries in areas without a well may be determined based on the number of boundaries within nearby wells. Anomalies in the region of interest may be detected based on the number of boundaries within the region of interest. The visualization 500 may highlight potential anomalies in the region of interest. For example, the visualization 500 may highlight individual wells and/or areas that are outliers. For instance, the visualization 500 may highlight wells that have fewer/more detected boundaries than nearby wells and/or areas in which the number of boundaries changes drastically/erratically. For example, the visualization 500 may highlight local deviations from the broader color/brightness trend, which may indicate problematic well data, erroneous correlation interval selection for a well, and/or local geologic variations. For instance, in FIG. 5, the gradual change in the visual characteristic(s) (e.g., color, brightness) of the surface (gradual change in the number of boundaries) may indicate that the subsurface configuration/pattern is in transition. The spike in the number of boundaries near the center may indicate the well(s) in the area are unreliable (e.g., bad well log, poor boundary identification) and/or that a localized change in subsurface configuration is occurring within that area.

Implementations of the disclosure may be made in hardware, firmware, software, or any suitable combination thereof. Aspects of the disclosure may be implemented as instructions stored on a machine-readable medium, which may be read and executed by one or more processors. A machine-readable medium may include any mechanism for storing or transmitting information in a form readable by a machine (e.g., a computing device). For example, a tangible computer-readable storage medium may include read-only memory, random access memory, magnetic disk storage media, optical storage media, flash memory devices, and others, and a machine-readable transmission media may include forms of propagated signals, such as carrier waves, infrared signals, digital signals, and others. Firmware, software, routines, or instructions may be described herein in terms of specific exemplary aspects and implementations of the disclosure, and performing certain actions.

In some implementations, some or all of the functionalities attributed herein to the system 10 may be provided by external resources not included in the system 10. External resources may include hosts/sources of information, computing, and/or processing and/or other providers of information, computing, and/or processing outside of the system 10.

Although the processor 11 and the electronic storage 13 are shown to be connected to the interface 12 in FIG. 1, any communication medium may be used to facilitate interaction between any components of the system 10. One or more components of the system 10 may communicate with each other through hard-wired communication, wireless communication, or both. For example, one or more components of the system 10 may communicate with each other through a network. For example, the processor 11 may wirelessly communicate with the electronic storage 13. By way of non-limiting example, wireless communication may include one or more of radio communication, Bluetooth communication, Wi-Fi communication, cellular communication, infrared communication, or other wireless communication. Other types of communications are contemplated by the present disclosure.

Although the processor 11 is shown in FIG. 1 as a single entity, this is for illustrative purposes only. In some implementations, the processor 11 may comprise a plurality of processing units. These processing units may be physically located within the same device, or the processor 11 may represent processing functionality of a plurality of devices operating in coordination. The processor 11 may be separate from and/or be part of one or more components of the system 10. The processor 11 may be configured to execute one or more components by software; hardware; firmware; some combination of software, hardware, and/or firmware; and/or other mechanisms for configuring processing capabilities on the processor 11.

It should be appreciated that although computer program components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented.

The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

The electronic storage media of the electronic storage 13 may be provided integrally (i.e., substantially non-removable) with one or more components of the system 10 and/or as removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

Figure 2:
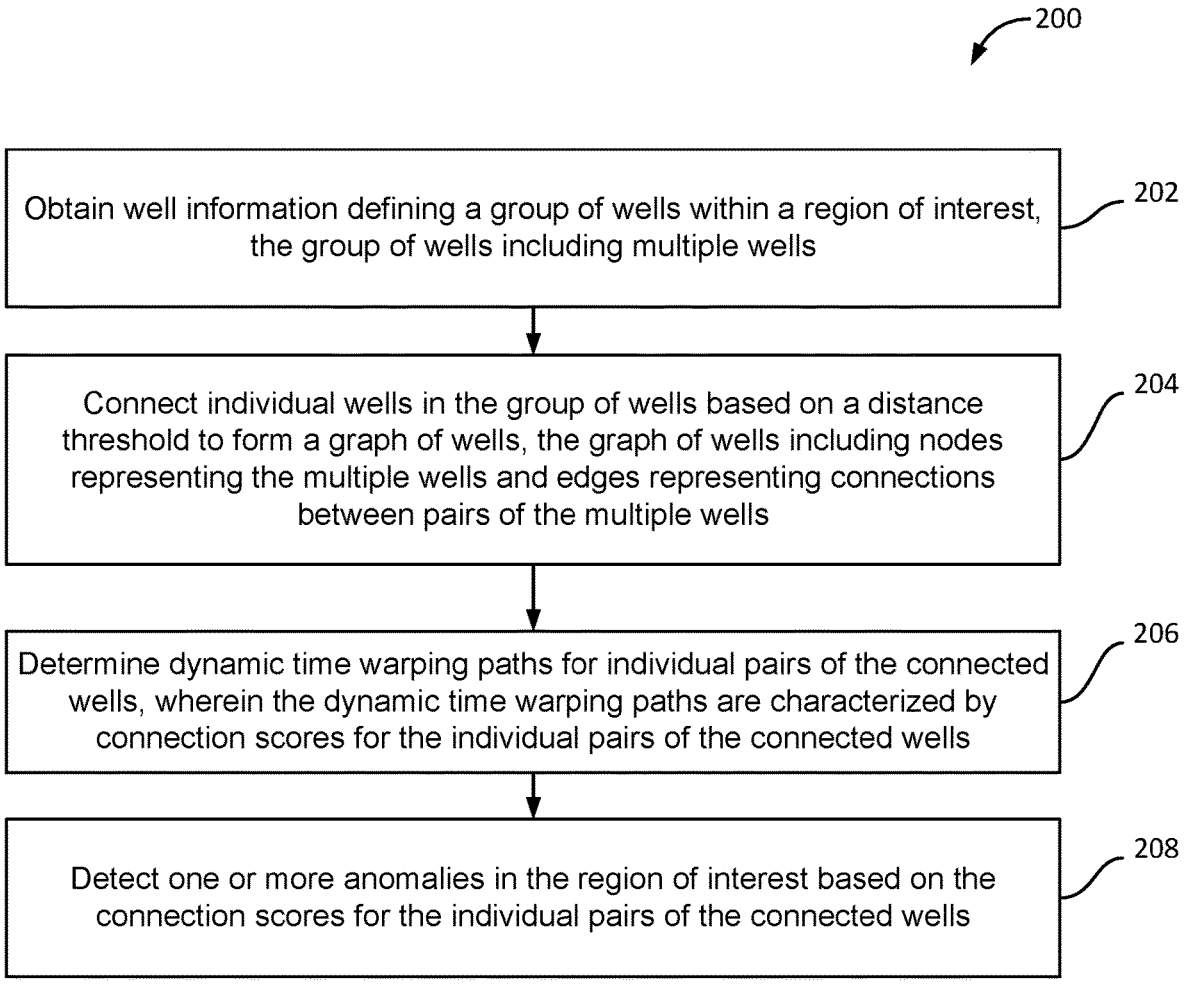
FIG. 2 illustrates an example method for detecting subsurface anomalies.

FIG. 2 illustrates method 200 for detecting subsurface anomalies. The operations of method 200 presented below are intended to be illustrative. In some implementations, method 200 may be accomplished with one or more additional operations not described, and/or without one or more of the operations discussed. In some implementations, two or more of the operations may occur substantially simultaneously.

In some implementations, method 200 may be implemented in one or more processing devices (e.g., a digital processor, an analog processor, a digital circuit designed to process information, a central processing unit, a graphics processing unit, a microcontroller, an analog circuit designed to process information, a state machine, and/or other mechanisms for electronically processing information). The one or more processing devices may include one or more devices executing some or all of the operations of method 200 in response to instructions stored electronically on one or more electronic storage media. The one or more processing devices may include one or more devices configured through hardware, firmware, and/or software to be specifically designed for execution of one or more of the operations of method 200.

Referring to FIG. 2 and method 200, at operation 202, well information and/or other information may be obtained. The well information may define a group of wells within a region of interest. The group of wells may include multiple wells. In some implementations, operation 202 may be performed by a processor component the same as or similar to the well information component 102 (Shown in FIG. 1 and described herein).

At operation 204, individual wells in the group of wells may be connected based on a distance threshold and/or other information to form a graph of wells. The graph of wells may include nodes representing the multiple wells and edges representing connections between pairs of the multiple wells. In some implementations, operation 204 may be performed by a processor component the same as or similar to the connection component 104 (Shown in FIG. 1 and described herein).

At operation 206, dynamic time warping paths for individual pairs of the connected wells may be determined. The dynamic time warping paths may be characterized by connection scores for the individual pairs of the connected wells. In some implementations, operation 206 may be performed by a processor component the same as or similar to the path component 106 (Shown in FIG. 1 and described herein).

At operation 208, one or more anomalies in the region of interest may be detected based on the connection scores for the individual pairs of the connected wells and/or other information. In some implementations, operation 208 may be performed by a processor component the same as or similar to the anomaly component 108 (Shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system for detecting subsurface anomalies, the system comprising:

one or more physical processors configured by machine-readable instructions to:

obtain well information, the well information defining a group of wells within a region of interest, the group of wells including multiple wells;

connect individual wells in the group of wells based on a distance threshold to form a graph of wells, the graph of wells including nodes representing the multiple wells and edges representing connections between pairs of the multiple wells, wherein two wells that are within the distance threshold of each other are connected, two wells that are not within the distance threshold of each other are not connected, further wherein connected wells are analyzed for detection of anomalies and unconnected wells are not analyzed for detection of anomalies;

determine dynamic time warping paths for individual pairs of the connected wells, wherein the dynamic time warping paths are characterized by connection scores for the individual pairs of the connected wells, wherein a given connection score for a given pair of the connected wells indicates similarity between the given pair of the connected wells; and detect an anomaly in the region of interest based on deviation of the connection scores for the individual pairs of the connected wells, wherein detection of the anomaly in the region of interest based on the deviation of the connection scores for the individual pairs of the connected wells includes:

identification of a given well as being characterized by an unreliable well log based on the connection scores for connections between the given well and nearby wells deviating from the connection scores for connections between the nearby wells; or identification of a geological boundary located between a first subgroup of wells and a second subgroup of wells based on the connection scores for connections between wells within the first subgroup of wells and wells within the second subgroup of wells deviating from the connection scores for connections between the wells within the first subgroup and the connection scores for connections between the wells within the second subgroup.

2. The system of claim 1, wherein the one or more physical processors are further configured by the machine-readable instructions to provide a visual representation of the graph of wells, wherein a visual characteristic of the edges representing the connections between the pairs of the multiple wells is determined based on the connection scores.

3. The system of claim 2, wherein the connection scores determine color of the edges representing the connections between the pairs of the multiple wells.

4. The system of claim 1, wherein:

the well information includes one or more well logs for the individual wells in the group of wells;

the one or more well logs for the individual wells are normalized based on a log scaling; and the dynamic time warping paths for the individual pairs of the connected wells are determined based on the one or more normalized well logs for the individual wells.

5. The system of claim 1, wherein the distance threshold is adjusted such that none of the multiple wells are isolated.

6. The system of claim 1, wherein:

the one or more physical processors are further configured by the machine-readable instructions to determine number of boundaries within the individual wells; and the anomaly in the region of interest is detected further based on the number of boundaries within the individual wells.

7. The system of claim 6, wherein the anomaly in the region of interest includes a transition between a third subgroup of wells and a fourth subgroup of wells within the region of interest identified based on a change in the number of boundaries within the third subgroup of wells and the fourth subgroup of wells.

8. The system of claim 6, wherein the one or more physical processors are further configured by the machine-readable instructions to provide a visual representation of the graph of wells, wherein a visual characteristic of the nodes representing the multiple wells is determined based on the number of boundaries within the individual wells.

9. The system of claim 8, wherein the visual characteristic of the nodes representing the multiple wells is gridded onto a surface representing the region of interest within the visual representation of the graph of wells.

10. The system of claim 9, wherein the number of boundaries within the individual wells are extrapolated to the region of interest to provide visualization of changes in the number of boundaries throughout the region of interest.

11. A method for detecting subsurface anomalies, the method comprising:

obtaining well information, the well information defining a group of wells within a region of interest, the group of wells including multiple wells;

connecting individual wells in the group of wells based on a distance threshold to form a graph of wells, the graph of wells including nodes representing the multiple wells and edges representing connections between pairs of the multiple wells, wherein two wells that are within the distance threshold of each other are connected, two wells that are not within the distance threshold of each other are not connected, further wherein connected wells are analyzed for detection of anomalies and unconnected wells are not analyzed for detection of anomalies;

determining dynamic time warping paths for individual pairs of the connected wells, wherein the dynamic time warping paths are characterized by connection scores for the individual pairs of the connected wells, wherein a given connection score for a given pair of the connected wells indicates similarity between the given pair of the connected wells; and detecting an anomaly in the region of interest based on deviation of the connection scores for the individual pairs of the connected wells, wherein detecting the anomaly in the region of interest based on the deviation of the connection scores for the individual pairs of the connected wells includes:

identifying a given well as being characterized by an unreliable well log based on the connection scores for connections between the given well and nearby wells deviating from the connection scores for connections between the nearby wells; or identifying a geological boundary located between a first subgroup of wells and a second subgroup of wells based on the connection scores for connections between wells within the first subgroup of wells and wells within the second subgroup of wells deviating from the connection scores for connections between the wells within the first subgroup and the connection scores for connections between the wells within the second subgroup.

12. The method of claim 11, further comprising providing a visual representation of the graph of wells, wherein a visual characteristic of the edges representing the connections between the pairs of the multiple wells is determined based on the connection scores.

13. The method of claim 12, wherein the connection scores determine color of the edges representing the connections between the pairs of the multiple wells.

14. The method of claim 11, wherein:

the well information includes one or more well logs for the individual wells in the group of wells;

the one or more well logs for the individual wells are normalized based on a log scaling; and the dynamic time warping paths for the individual pairs of the connected wells are determined based on the one or more normalized well logs for the individual wells.

15. The method of claim 11, wherein the distance threshold is adjusted such that none of the multiple wells are isolated.

16. The method of claim 11, further comprising determining number of boundaries within the individual wells, wherein the anomaly in the region of interest is detected further based on the number of boundaries within the individual wells.

17. The method of claim 16, wherein the anomaly in the region of interest includes a transition between a third subgroup of wells and a fourth subgroup of wells within the region of interest identified based on a change in the number of boundaries within the third subgroup of wells and the fourth subgroup of wells.

18. The method of claim 16, further comprising providing a visual representation of the graph of wells, wherein a visual characteristic of the nodes representing the multiple wells is determined based on the number of boundaries within the individual wells.

19. The method of claim 18, wherein the visual characteristic of the nodes representing the multiple wells is gridded onto a surface representing the region of interest within the visual representation of the graph of wells.

20. The method of claim 19, wherein the number of boundaries within the individual wells are extrapolated to the region of interest to provide visualization of changes in the number of boundaries throughout the region of interest.

* * * * *